United States Patent [19]

Goransson

[11] 3,973,795

[45] Aug. 10, 1976

[54] LIFTING DEVICE FOR HANDLING CUT CELLULAR CONCRETE BODIES

[75] Inventor: Rolf Erik Goransson, Akarp, Sweden

[73] Assignee: Internationella Siporex Aktiebolaget, Malmo, Sweden

[22] Filed: Aug. 19, 1975

[21] Appl. No.: 605,966

[30] Foreign Application Priority Data

Aug. 20, 1974 Sweden ..... 7410555

[52] U.S. Cl. ..... 294/65; 294/87 R; 214/1 BT; 198/34

[51] Int. Cl.[2] ..... B66C 1/02

[58] Field of Search ..... 294/65, 63 R, 64, 65.5, 294/81 R, 87 R, 87 A, 63 A; 214/1 BV, 1 BT, 1 BH, 147 T, 152, 309; 198/34, 34 A; 53/166, 247; 425/123

[56] References Cited

UNITED STATES PATENTS

| | | | |
|---|---|---|---|
| 3,302,967 | 2/1967 | Harris et al. | 294/65 |
| 3,542,412 | 11/1970 | Kock et al. | 214/1 BT |
| 3,610,673 | 10/1971 | Albin et al. | 294/64 |

*Primary Examiner*—James B. Marbert
*Attorney, Agent, or Firm*—Fred Philpitt

[57] ABSTRACT

A load-lifting device comprises a generally horizontal frame to be lifted and a plurality of load-engaging carriers movable by means of actuators along said supporting frame in a direction, in which the carriers form a row. Every two adjacent carriers are interconnected by a group of actuators that is operable independently of all the other actuator groups, and only one of said interconnected carriers is connected to the frame by actuator means defining the position of all said interconnected carriers relative to the frame.

6 Claims, 5 Drawing Figures

LIFTING DEVICE FOR HANDLING CUT CELLULAR CONCRETE BODIES

Figure 1:
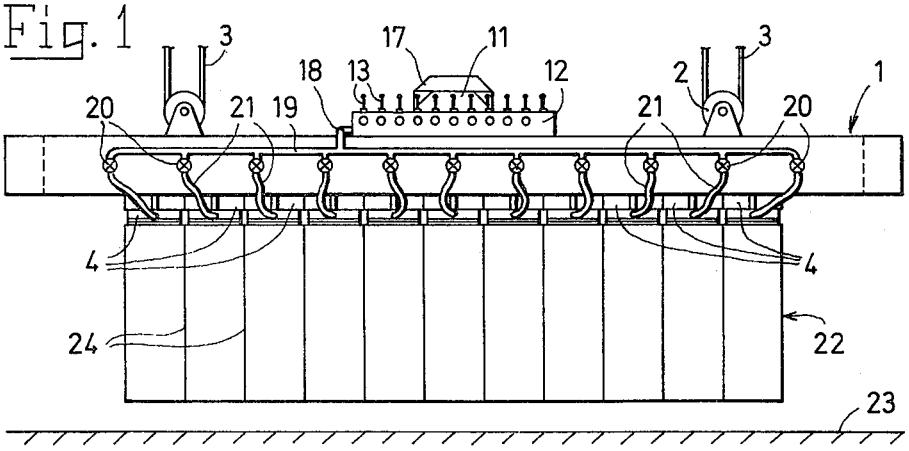

This invention relates to a lifting device especially designed for changing the distance between separate parts of a generally parallelepipedic cellular lightweight concrete body that has been divided by at least one vertically extending cut and, more specifically, to a lifting device of the kind comprising a generally horizontal frame structure that is vertically movable in relation to a support, from which the cut body may be lifted, a plurality of carriers, each of which has means thereon for gripping a part of the body and for keeping that body part suspended when lifted, means supportingly connecting each of said carriers to said frame structure in a manner to permit guided movements of each and all of the various carriers relative to said supporting frame structure in a predetermined, generally horizontal direction, in which said carriers form a row, and a plurality of actuators for moving said carriers in said predetermined direction.

In the manufacture of slabs or blocks of cellular lightweight concrete it is common practice to first mold a large body of cellular concrete mass and to then divide this body into a number of smaller units, when the body mass has solidified to become more or less plastic in consistency but has still not been steamhardened in the autoclave. Ordinarily, one process step after molding is to remove a more or less irregular top layer from the body so as to give it a smooth top surface and a generally parallelepipedic shape. Another customary process step is to divide the large body into a number of smaller parts by at least one vertical cut at an early manufacturing stage, frequently already when the solidified body has been exposed on its casting bed by removal of the mold walls.

When the manufacturing process has advanced that far, it is often desirable to move the various parts of the body slightly away from each other to widen the cuts between them, before further treatment of the body parts, such as further cutting, is accomplished. The reason for this may be, for example, that it is desirable to use the widened cuts for inserting holders or frames having cutting wires therein or for changing the relative distances between the cutting wires in such a holder or frame, when further cutting of the body parts is to be carried out.

In the cellular lightweight concrete industry it is well known since long ago to lift and handle still unhardened cellular concrete bodies by means of suction heads, which are brought to adhere to the top side of the body, or by means of gripping jaws adapted to engage opposite vertical side faces of the body and to thus clamp the same. It is also known to combine such suction heads and gripping jaws in lifting devices for cellular concrete bodies. However, there are no lifting devices known so far, which are useful for both lifting a cut body and for subsequently widening the cuts therein irrespective of the number and location, within certain limits, of said cuts. Certainly there are many kinds of lifting devices known from other industrial or load-handling fields, which include a plurality of movable load grippers, but in them the various grippers are only movable in unison, such as by lazy-tongs or like interconnecting systems, whereby they are entirely unsatisfactory for the purpose in question.

Accordingly, this invention has for its object to provide an improved lifting device of the kind defined, which is not suffering from the deficiencies just referred to, and which is therefore particularly adequate for a more advanced handling of precut plastic bodies in the manufacture of building slabs or blocks of cellular lightweight concrete as described hereinbefore.

In order to achieve the above object the dominant features of the improved lifting device embodying the invention are that there is one actuator group directly connecting every two adjacent carriers, each such actuator group being operable selectively and independently of all the other groups and without positional reference to said frame structure, and that one of said interconnected carriers only is connected to said supporting frame structure by means defining the position of said one carrier relative to said frame structure.

Figure 2:
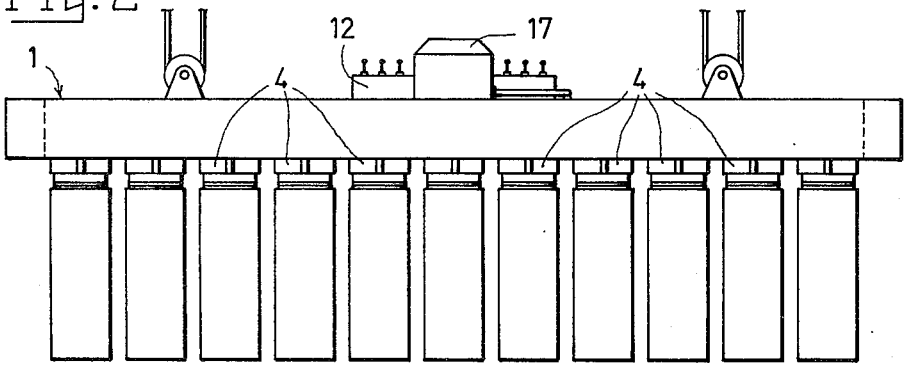
Figure 3:
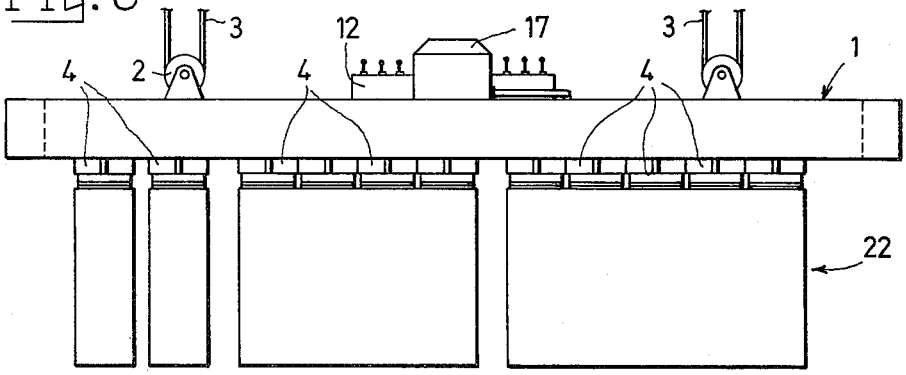
Figure 4:
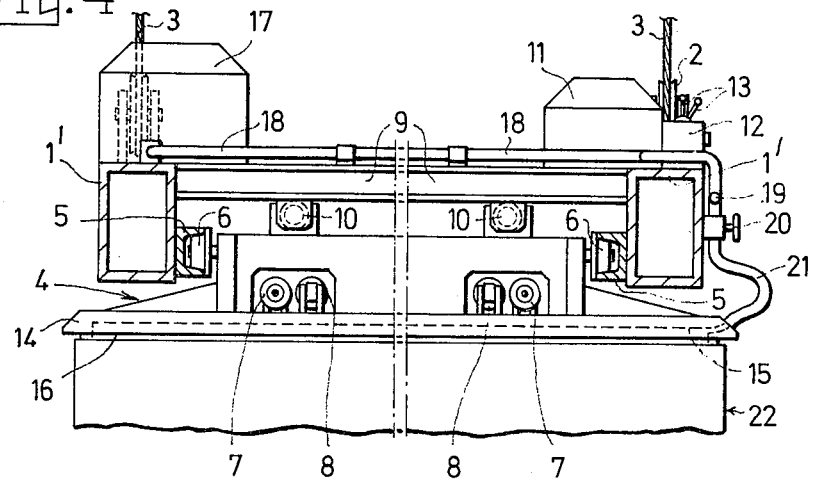
Figure 5:
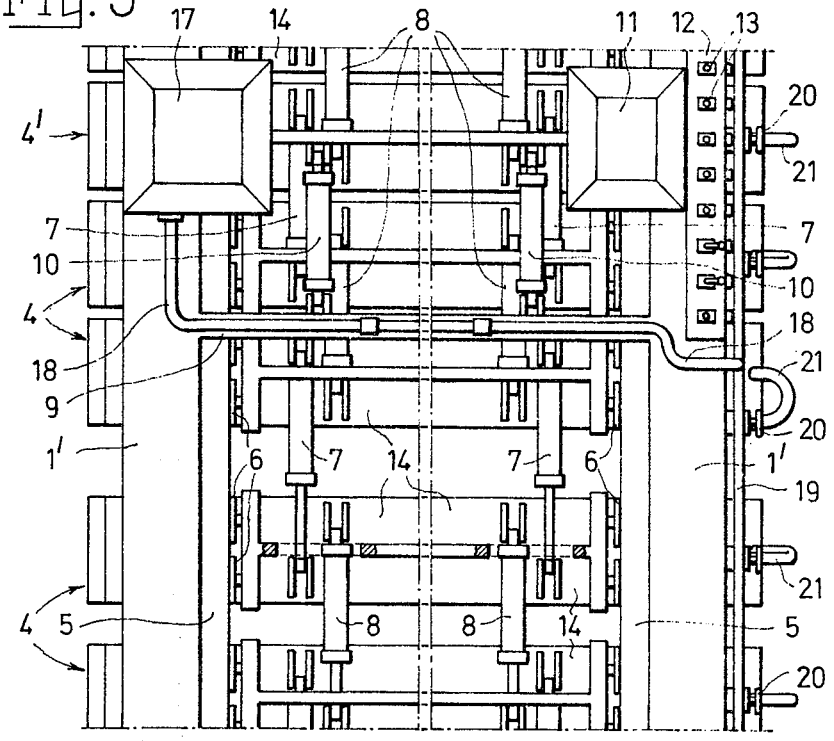

Further features of the improved lifting device embodying the invention will appear from the following description of a preferred form thereof which, by way of example, has been illustrated in the accompanying drawings, wherein FIG. 1 is a front side elevation of the improved lifting device showing also how a first regularly cut cellular lightweight concrete body has just been lifted from a support by means of the device, FIG. 2 is a rear side elevation of the same device as in FIG. 1 showing all its carriers and their related parts of the lifted cut body uniformly spread apart, as may sometimes be desirable, FIG. 3 is a similar rear side elevation showing the same device as in FIGS. 1 and 2 but used for a more irregular spreading apart of a smaller number of differently sized parts of a second cellular lightweight concrete body, FIG. 4 is a shortened and enlarged cross sectional elevation of the improved lifting device, and FIG. 5 is a partial and also shortened top plan view of the improved lifting device on the same scale as in FIG. 4.

The lifting device shown in the drawings comprises primarily a rectangular and generally horizontal, rigid frame structure 1, the upper side of which is provided with pulleys 2 for wire ropes 3, by means of which the frame structure is suspended in a vertically adjustable manner from an overhead traveling crane or the like (not shown) that can also be used for moving the device horizontally, if and when desirable. The lifting device furthermore includes a plurality of elongate carriers 4, which extend in the transverse direction of the frame structure and are arranged side by side in parallel relationship so as to form a single row in the longitudinal direction of the frame 1. As appears from FIGS. 4 and 5, a rail or beam 5 serving as a runway is secured to the inner side of each of the two longitudinal side members 1' of the frame structure 1, and each carrier 4 is formed as a carriage having wheels 6, two at each end, which guidingly roll along these rails 5.

Between every two adjacent carriers 4 there is provided a pair of double-acting pneumatic or hydraulic power cylinders 7 or 8, respectively, having the usual pistons and piston rods. These power cylinders interconnecting adjacent carriers 4 serve as actuators, by means of which any two adjacent carriers may be moved away from or towards each other in the longitudinal direction of the frame structure while maintaining their parallel relationship. To achieve a sufficient maximum stroke of the pistons in the cylinders 7 or 8, respectively, the various pairs of power cylinders are arranged in zigzag or staggered relationship, as appears from FIG. 5. One of the carriers 4′ is, in addition, connected to a cross member 9 in the frame structure 1 by means of a further pair of double-acting pneumatic or hydraulic cylinders 10 making possible an adjustment of the position of said one carrier in the longitudinal direction of the frame structure 1 and a retention or locking of said one carrier 4′ in that adjusted or selected position. In this way all the various carriers 4 are prevented from moving in an uncontrolled manner relative to the frame structure 1, when they are actuated by the power cylinders 7 and 8, in spite of the fact that none of said latter cylinders is connected to the frame structure.

The frame structure 1 supports a pump unit 11 serving as a source of air or oil under pressure that is required to drive the various cylinders 7, 8 and 10. The pressure fluid is distributed to the various pairs of co-operating cylinders 7, 8, and 10 through control valves collected and mounted on a common control panel 12 secured on top of one of the longitudinal side members of the frame structure 1, and through at least partially flexible conduits (not shown). Each pair of co-operating cylinders 7, 8 and 10 has its own operating lever 13 on the control panel 12, so that any two adjacent carriers 4 may be selectively moved either away from or towards each other, as required, and all the interconnected carriers may be moved and positioned collectively in relation to the frame structure by means of the power cylinders 10, if necessary. It is preferred in this connection to use power cylinders 7 and 8 and appertaining pressure supply circuits of the type, well known per se, which permit a stepwise variation of the piston stroke and remote selection thereof from the control panel 12, whereby the operator can choose between a full stroke and a half stroke, for instance, when the distance between two adjacent carriers is to be increased. When the various carriers 4 are closest to each other, each of them preferably is in physical contact with the next adjacent one or ones. The carrier 4′ is suitably one in the middle of the row or approximately so, and the power cylinders 10 connecting it to the frame structure 1 are preferably operable to vary the position of said one carrier selectively without any defined steps.

In the example shown, each carrier 4 is formed with a lower, cap-like portion 14 having in its bottom side a shallow recess 15, around the downwardly facing marginal rim of which an elastic sealing element 16 is provided. This cap-like portion 14 forms a suction head that can be evacuated by means of a suction pump unit 17 carried by the frame structure 1. More particularly, the unit 17 is connected through a suction pipe 18 and a distributing pipe 19 to a plurality of evacuator valves 20, one for each carrier, and each such valve is connected to the cap-like portion 14 of a related carrier through a flexible suction conduit 21.

The device thus described is intended to be used for lifting a cellular lightweight concrete body, generally designated by 22, from a support 23. The body 22, the total length of which must, of course, be shorter than that of the frame structure 1, is supposed to be divided into two or more parts by an arbitrary number of transverse, vertical cuts 24 paralleling the elongate carriers 4, the maximum number of body parts being, of course, limited to the number of carriers 4. The width of each carrier 4 is chosen so as to be equal to or smaller than the length of the smallest body part counted in the longitudinal direction of the body 22 and the frame structure 1. In FIGS. 1 and 2 the body 22 is divided into the smallest parts possible, one for each carrier 4. When this cut body has been lifted from the support 23, the various parts thereof can be spread apart uniformly as shown in FIG. 2 or in any other desirable pattern, such as in groups of two, in groups of different numbers, and so on. FIG. 3 on the other hand shows a similar cellular lightweight concrete body divided by only three vertical cuts into four separate parts, two of which are carried by each one single carrier 4, whereas each one of the other two body parts is carried by several carriers in co-operation. When the cut body has been lifted and its parts have been spread apart as desired, the spread apart body parts may, of course, be deposited onto the support 23 or some other suitable bed. Similarly, the body parts may later on be lifted again by means of the lifting device after any possible treatment and then be brought together again, if so desired. Particularly when the various parts of the cut and lifted body are spread apart irregularly, it may be desirable or even necessary, for instance in order to distribute the load evenly among the ropes 3 by which the frame structure is suspended, to adjust by means of the cylinders 10 the position of the carrier 4′, and consequently the positions of all the interconnected carriers 4, relative to the frame structure 1.

Although in the embodiment described hereinbefore the carriers 4 are designed solely for gripping the body parts by suction, it should be understood that the carriers may instead be designed for gripping the body parts by grasping or clamping them between suitable jaws, or suction and mechanical clamping may be combined. Also, each carrier 4 may be provided with two or more suction heads instead of only one, as shown and described. Furthermore, the detailed design of all the various components of the device may be varied in several respects within the scope of the appended claims. The two units 11 and 17 may be removed from the frame structure 1 and instead be placed remote from the lifting device proper, provided that they are connected to the latter through at least partially flexible conduits. The control valves in the control panel 12 like the valves 20 on the frame structure 1 may be remotely controlled, if found convenient, and the size of the various components of the device as well as the number of carriers on the frame structure may be varied to meet the actual demand. There may even be two or more separate groups or rows of carriers on a common frame structure, if so desired.

I Claim:

1. A lifting device for changing the distance between separate parts of a generally parallelepipedic cellular lightweight concrete body that has been divided by at least one vertically extending cut comprising a generally horizontal frame structure that is vertically movable in relation to a support, from which the cut body may be lifted, a plurality of carriers, each of which has means thereon for gripping a part of the body and for keeping that body part suspended when lifted, means supportingly connecting each of said carriers to said frame structure in a manner to permit guided movements of each and all of the various carriers relative to said supporting frame structure in a predetermined, generally horizontal direction, in which said carriers form a row, and a plurality of actuators for moving said carriers in said predetermined direction, wherein there is one actuator group directly connecting every two adjacent carriers, each such actuator group being operable selectively and independently of all the other groups and without positional reference to said frame structure, and wherein one of said interconnected carriers only is connected to said supporting frame structure by means defining the position of said one carrier relative to said frame structure.

2. A lifting device according to claim 1 wherein said position defining means for said one carrier are adjustable to permit a selective variation of the position of said one carrier relative to said frame structure.

3. A lifting device according to claim 2 wherein said adjustable position defining means for said one carrier comprise at least one power cylinder interconnected between said one carrier and said supporting frame structure.

4. A lifting device according to claim 1 wherein said actuators interconnecting every two adjacent carriers are power cylinders arranged in pairs between adjacent ones of said carriers.

5. A lifting device according to claim 4 wherein said pairs of power cylinders are arranged in staggered relationship between their respective carriers, each pair of power cylinders having its respective ends extending beyond the ends of the adjacent pairs of power cylinders.

6. A lifting device according to claim 1 wherein said means on each carrier for gripping a part of the body comprise at least one suction head.

* * * * *